US006675909B1

(12) United States Patent
Cowart et al.

(10) Patent No.: US 6,675,909 B1
(45) Date of Patent: Jan. 13, 2004

(54) HYDRAULIC JAR

(75) Inventors: J. Wayne Cowart, Oklahoma City, OK (US); Michael R. Shurtleff, Del City, OK (US)

(73) Assignee: Jack A. Milam, Blanchard, OK (US); part interest ( * ) Notice: Subject to any disclaimer, the term of this patent is extended or adjusted under 35 U.S.C. 154(b) by 0 days.

(21) Appl. No.: 10/329,989

(22) Filed: Dec. 26, 2002

(51) Int. Cl.[7] ..... B25D 17/14; E21B 1/12
(52) U.S. Cl. ..... 173/91; 173/78; 175/296
(58) Field of Search ..... 173/90, 91, 73, 173/78, 80, 64; 175/296, 19

(56) References Cited

U.S. PATENT DOCUMENTS

| | | | | |
|---|---|---|---|---|
| 3,757,816 | A | | 9/1973 | Price |
| 3,877,530 | A | | 4/1975 | Dowmen |
| 3,974,876 | A | | 8/1976 | Taylor |
| 4,036,297 | A | | 7/1977 | Swihart, Sr. |
| 4,111,271 | A | | 9/1978 | Perkins |
| 4,179,002 | A | | 12/1979 | Young |
| 4,181,186 | A | | 1/1980 | Blanton |
| 4,186,807 | A | | 2/1980 | Sutliff et al. |
| 4,196,782 | A | | 4/1980 | Blanton |
| 4,211,293 | A | | 7/1980 | Blanton |
| 4,462,471 | A | | 7/1984 | Hipp |
| 4,524,838 | A | | 6/1985 | Sutliff |
| 4,607,692 | A | | 8/1986 | Zwart |
| 4,865,125 | A | | 9/1989 | De Cuir |
| 5,007,479 | A | | 4/1991 | Pleasants et al. |
| 5,012,871 | A | | 5/1991 | Pleasants et al. |
| 5,094,303 | A | | 3/1992 | Jenne |
| 5,117,922 | A | | 6/1992 | Baron |
| 5,123,493 | A | | 6/1992 | Wenzel |
| 5,211,241 | A | | 5/1993 | Mashaw, Jr. et al. |
| 5,226,487 | A | | 7/1993 | Spektor |
| 5,330,018 | A | | 7/1994 | Griffith |
| 5,411,107 | A | | 5/1995 | Hailey et al. |
| 5,413,185 | A | | 5/1995 | Kayes |
| 5,495,902 | A | | 3/1996 | Hailey et al. |
| 5,595,244 | A | | 1/1997 | Roberts |
| 5,595,253 | A | | 1/1997 | Martin et al. |
| 5,603,383 | A | | 2/1997 | Wentworth et al. |
| 5,647,446 | A | | 7/1997 | Wenzel |
| 5,794,718 | A | | 8/1998 | Zollinger et al. |
| 5,803,182 | A | | 9/1998 | Bakke |
| 5,918,689 | A | | 7/1999 | Roberts |
| 5,968,312 | A | | 10/1999 | Sephton |
| 5,984,028 | A | | 11/1999 | Wilson |
| 6,035,954 | A | | 3/2000 | Hipp |
| 6,047,778 | A | * | 4/2000 | Coffman et al. ..... 175/296 |
| 6,050,346 | A | * | 4/2000 | Hipp ..... 173/80 |
| 6,050,347 | A | | 4/2000 | Jenne |
| 6,062,324 | A | | 5/2000 | Hipp |
| 6,152,222 | A | | 11/2000 | Kyllingstad |
| 6,164,393 | A | | 12/2000 | Bakke |
| 6,202,767 | B1 | | 3/2001 | Friis |
| 6,263,986 | B1 | | 7/2001 | Massner et al. |
| 6,269,889 | B1 | | 8/2001 | Wentworth |
| 6,290,004 | B1 | | 9/2001 | Evans |
| 6,439,318 | B1 | * | 8/2002 | Eddison et al. ..... 173/91 |
| 6,474,421 | B1 | * | 11/2002 | Stoesz ..... 173/91 |

* cited by examiner

*Primary Examiner*—Scott A. Smith
(74) *Attorney, Agent, or Firm*—Mary M. Lee

(57) ABSTRACT

An improved bidirectional hydraulic jar. The jar comprises a two-ring valve assembly supported preferably on the inner mandrel for reciprocal movement inside a fluid chamber. The chamber comprises two larger portions joined by a narrowed restrictor portion. The valve obstructs passage of fluid through the restrictor portion except for a bleed passage, which comprises an adjustable metering space between the two valve rings. The jarring force can be adjusted by varying the size of the metering space, which is done simply by axially repositioning one of the valve rings. All impact surfaces are enclosed in the housing to prevent downhole debris from dampening the blows. The shoulder on the exposed end of the mandrel is champfered to prevent build-up of debris and to facilitate removal of the tool from the well. This jar can be re-cocked easily, without firing in the reverse direction, for unidirectional jarring operations.

13 Claims, 6 Drawing Sheets

HYDRAULIC JAR

FIELD OF THE INVENTION

The present invention relates generally to hydraulic jarring tools.

BACKGROUND OF THE INVENTION

Bidirectional hydraulic jars have provided much needed versatility in the removal of objects lodged in the casings of oil and gas wells. However, there remains a need for a bidirectional jar that is easily adjustable. There is a need for a jarring tool in which the impact surfaces are enclosed and protected from accumulation of debris and the resulting dampening of the blows. There is a need for a tool in which the exposed shoulders on the tool are champfered to facilitate removal from the well. Still further there is a need for a bidirectional jarring tool that can be re-cocked easily, without firing in the reverse direction, for unidirectional jarring operations. The preferred embodiment of the present invention provides these and other advantages as will be apparent from the following description.

SUMMARY OF THE INVENTION

The present invention comprises a bidirectional hydraulic jar. The jar comprises an outer assembly and an inner assembly. The outer assembly comprises a tubular body with first and second ends. The tubular body defines an inner wall, and the first end comprises a connecting portion. A first impact surface is provided on the tubular body to transmit force in a first direction, and a second impact surface is provided on the tubular body longitudinally spaced from the first impact surface to transmit force in a second direction opposite the first direction.

The inner assembly comprises an elongate body having a portion telescopically receivable within the outer assembly. The elongate body defines an outer wall and has first and second ends. The second end comprises a connecting portion. A first impact surface is provided on the elongate body and is adapted to engage the first impact surface on the tubular body of the outer assembly. A second impact surface is provided on the elongate body longitudinally spaced a distance from the second impact surface on the elongate body and adapted to engage the second impact surface on the tubular body of the outer assembly.

An annular elongate fluid chamber is formed between the outer wall of the elongate body of the inner assembly and the inner wall of the tubular body of the outer assembly. The fluid chamber comprises first and second portions and a restrictor portion therebetween. The restrictor portion has a smaller radial dimension than the first and second portions.

A valve assembly is supported in the fluid chamber and fixed to one of the outer wall of the elongate body of the inner assembly and the inner wall of the tubular body of the outer assembly. The valve assembly is sized for reciprocal movement in the restrictor, and is adapted to obstruct fluid flow through the restrictor portion except for a bleed passage therethrough. This arrangement creates a delay as the valve assembly moves through the restrictor portion and accelerated movement as the valve assembly exits the restrictor portion into the first and second portions of the fluid chamber.

The valve assembly comprises a first valve ring comprising first and second ends with a body therebetween. The first end defines a metering face. A second valve ring comprises first and second ends with a body therebetween. The first end defines a metering face adjacent the metering face of the first ring and forms therewith a metering space between the first and second valve rings. The metering space forms part of the bleed passage.

At least one of the first and second valve rings is sized for sealing engagement with the restrictor passage and comprises a pass-though opening continuous with the metering space and forming part of the bleed passage. The size of the metering space is adjustable by moving at least one of the first and second valve rings relative to the other to vary the size of the bleed passage.

In this way, movement of a selected one of the outer assembly and inner assembly relative to the other one in a first direction causes jarring impacts between the first impact surfaces of the outer and inner assemblies to thrust the jar in a first direction. Movement of the selected one of the outer assembly and inner assembly relative to the other one in a second direction causes jarring impacts between the second impact surfaces of the outer and inner assemblies to thrust the jar in a second direction. Adjusting the size of the metering space between the first and second valve rings varies the force and speed of the jarring impacts.

BRIEF DESCRIPTION OF THE DRAWINGS

FIG. 5 is an enlarged cross sectional view of the second valve ring taken along the line 7–7 in FIG. 7.

DETAILED DESCRIPTION OF THE PREFERRED EMBODIMENT

Figure 1A:
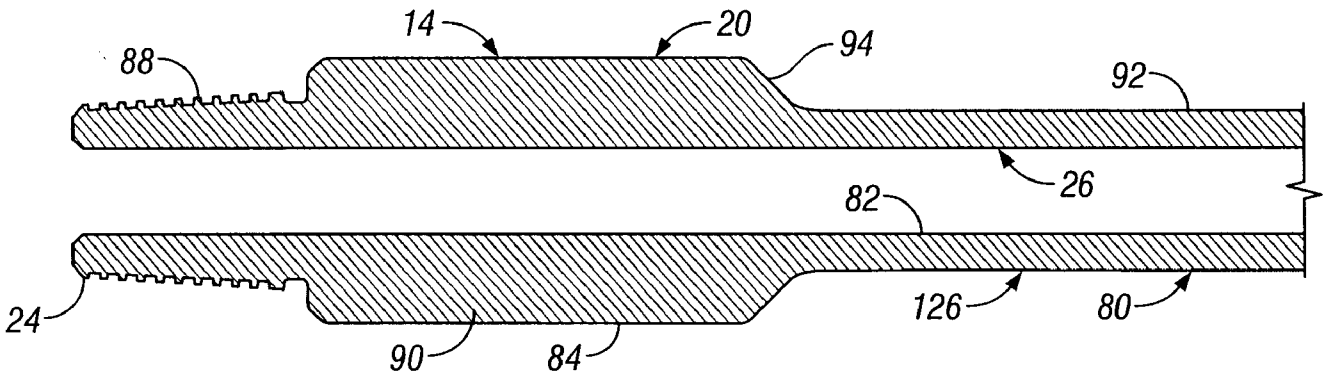
FIGS. 1A, 1B, 1C and 1D are sequential longitudinal sections of a hydraulic jar made in accordance with the present invention and shown in the open position.

Turning now to the drawings in general and to FIGS. 1A–1D and 2A–2D in particular, there is shown therein a bidirectional hydraulic jar made in accordance with the present invention and designated generally by the reference numeral 10. The jar 10 generally comprises an outer assembly 12, an inner assembly 14 and a valve assembly 16. The jar 10 is shown in the open or extended position in FIGS. 1A–1D, and in the closed or compressed position in FIGS. 2A–2D.

The outer assembly 12 comprises a housing or tubular body 20. In the preferred embodiment, the tubular body 20 is composed of several components threaded together. However, it will be understood that the number and nature of these components can vary widely. Moreover, the tubular body 20 may be integrally formed.

The preferred tubular body 20 has first and second ends 22 and 24 and has an inner bore defined by an inner wall 26. Preferably, the tubular body 20 comprises a top sub 30 with first and second ends 32 and 34. The first end 32 forms the first end 22 of the tubular body 20 and may comprise a box end with internal threads 36 or other suitable connecting portion. For example, the first end 22 may be adapted for connection to coil tubing or to another suitable elongate conduit or rod to be suspended in the well and manipulated to operate the jar, as will be described in more detail hereafter. In most instances the second end 34 of the top sub 30 will be externally threaded forming a pin end. The top sub 30 may be made of 4140 heat treated steel, 110 MYS.

The tubular body 20 preferably also comprises a fluid housing 40 having first and second ends 42 and 44, which preferably are internally threaded box ends. The first box end 42 threadedly connects to the second pin end. 34 of the top sub 30. The fluid housing 40 may be made of 4140 heat treated steel, 110 MYS.

Also included as part of the outer assembly is a connecting sub 50 having first and second ends 52 and 54. The first and second ends 52 and 54 preferably are externally threaded pin ends. Thus, the first pin end 52 is connectable to the second box end 44 of the fluid housing 40. The connecting sub 50 may be made of 4140 heat treated steel, 110 MYS.

Moving down the tool from the top sub 30 is a hammer housing 60. The preferred hammer housing 60 comprises first and second ends 62 and 64. Preferably the first and second ends 62 and 64 are internally threaded box ends. Thus, the first box end 62 is connectable to the second pin end 54 of the connecting sub. The inside wall of the hammer housing 60 may be provided with longitudinal grooves 66 for a reason which will become apparent. The hammer housing 60 may be made of 4140 heat treated steel, 110 MYS.

Forming the end of the preferred outer assembly 20 is a lower mandrel sub 70 with first and second ends 72 and 74. The first end 72 of the lower mandrel sub 70 preferably is an externally threaded pin end so as to be connectable to the second box end 64 of the hammer housing 60. As illustrated in the drawings, the exposed end of the lower mandrel sub preferably is champfered at 76 so as to facilitate insertion of the jar into the well and to discourage the collection of debris as the jar is reciprocated. The lower mandrel sub 70 may be made of 4140 heat treated steel, 110 MYS.

Having described the main structural components of the outer assembly 12 forming the tubular body 20, the preferred construction of the inner assembly 14 will be described. The inner assembly 14 preferably comprises a mandrel or elongate body 80. The elongate body 80 preferably is tubular to provide a fluid conduit 82 therethrough. However, a solid rod or other non tubular member may be substituted. As used herein, "tubular" denotes having a central throughbore, but is not limited to a member having a circular cross sectional configuration. It may be polygonal, having multiple straight sides, or have other shapes.

The elongate body 80 may be integrally formed but preferably will be formed of several components, usually threadedly connected. In the preferred embodiment, the elongate body 80 comprises a lower mandrel 84 having first and second ends 86 and 88. Preferably, both the first and second ends are externally threaded pin ends. The second end 86, which forms the second end of the elongate body 80, may be used to connect, directly or indirectly, to the object stuck in the well or to any other downhole tool. The lower mandrel 84 usually will be provided with a large diameter portion 90 and a small diameter portion 92 forming an annular shoulder 94 therebetween. Preferably, this shoulder 94 is champfered as this will discourage the accumulation of debris and will facilitate the removal of the jar 10 from the well. The lower mandrel 84 may be made of any steel alloy of 140 MYS.

In the preferred design, the elongate body 80 comprises an impact transfer member 100 having first and second ends 102 and 104, which preferably both have threaded box ends. The second box end 104 of the impact transfer member 100 is threadedly connected to the first pin end 86 of the lower mandrel 86. The outer wall of the impact transfer member 100 preferably is provided with longitudinal ribs 106, configured to ride in the longitudinal grooves 66 of the hammer housing 60. This prevents rotation of the inner assembly 14 relative to the outer assembly 12, without hindering telescopic movement. The impact transfer member 100 may be made of any steel alloy of 140 MYS.

Still further, the inner assembly 14 comprises an inner mandrel 108 having an outer wall 110 and first and second ends 112 and 114. The first end 112 forms the first end of the elongate body 80. The second end 114 of the inner mandrel 108 preferably is externally threaded for connection to the first box end 102 of the impact transfer member 100. The outer wall 100 of the inner mandrel 108 comprises an intermediate section 118 and a reduced diameter section 120 extending from the first end 112 to the intermediate section and forming an annular shoulder 122 therebetween. The inner mandrel 108 may be made of alloy steel with high tensile and yield strength, such as EDT 150.

Now it will be appreciated that the various components of the elongate body 80 collectively form an outer wall 126, and that a portion of the elongate body is telescopically received in the tubular body 20 of the outer assembly 12. In this embodiment, the inner mandrel 108, the impact transfer member 100 and the small diameter portion 92 of the lower mandrel 84 are slidably received in the outer assembly 12.

The jar 10 comprises a hammer assembly for creating jarring impacts in the tool in opposite directions. To this end, the tubular body 20 is provided with a first impact surface 130 to transmit force in a first direction, in this case toward the first end of the tubular body. In this embodiment, the first impact surface 130 (FIG. 1C) is found on the second end 54 of the connecting sub 50; however, it will be appreciated that a suitable surface could be provided in other locations. A second impact surface 132 (FIG. 2A) is also provided on the tubular body 20. The second impact surface 132 is spaced longitudinally from the first impact surface 130 and is positioned to transmit force received in a second direction opposite the first direction. In this case, the second direction is toward the second end 24 of the tubular body 20. Preferably, the second impact surface 132 is provided on the first end 72 of the lower mandrel sub 70.

Figure 1B:
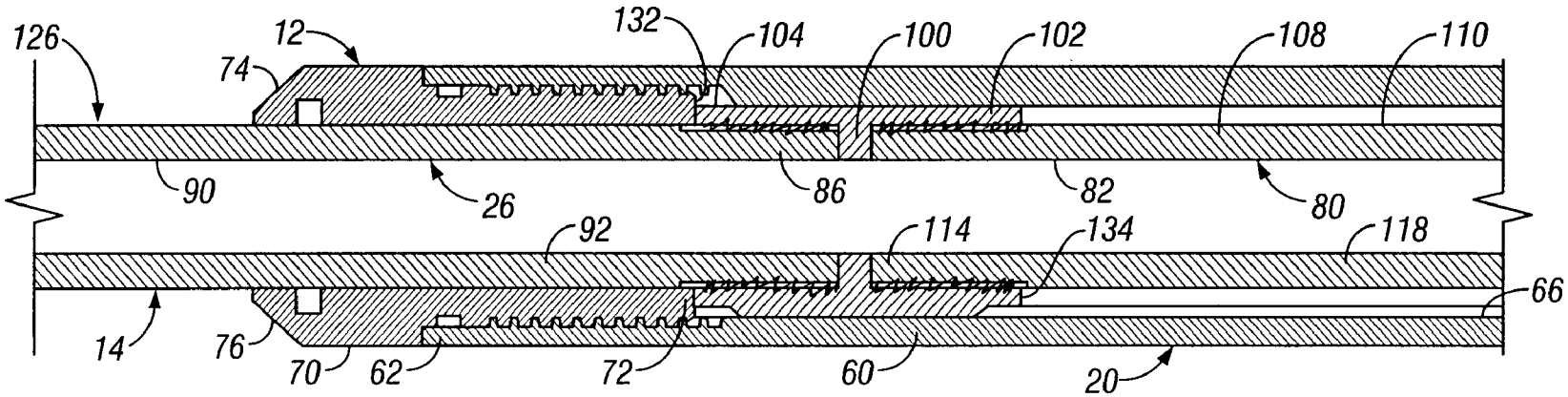
Figure 1C:
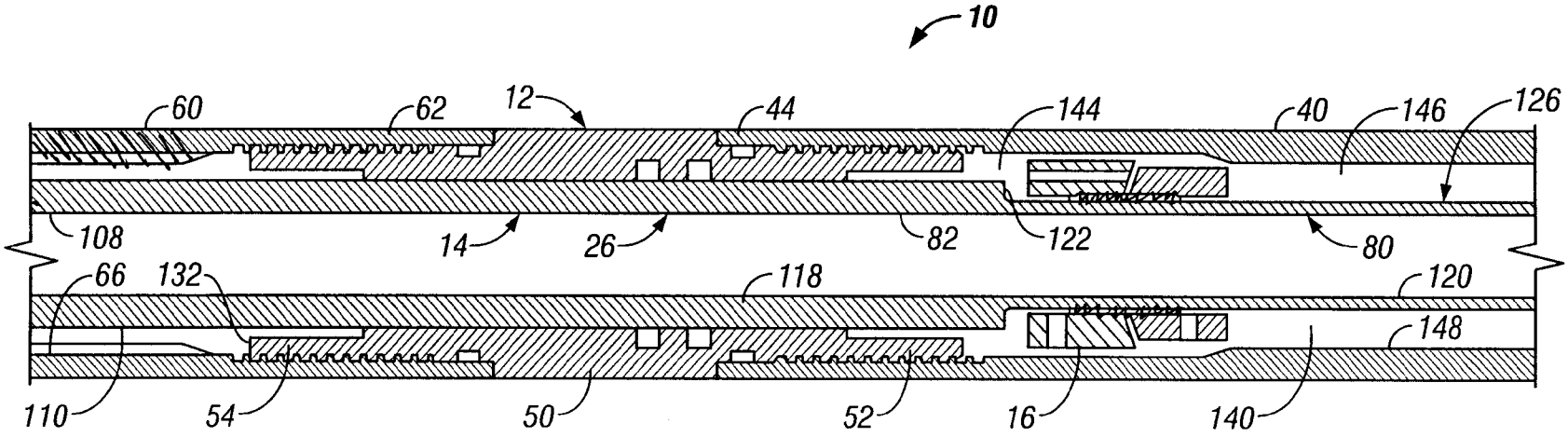
Figure 1D:
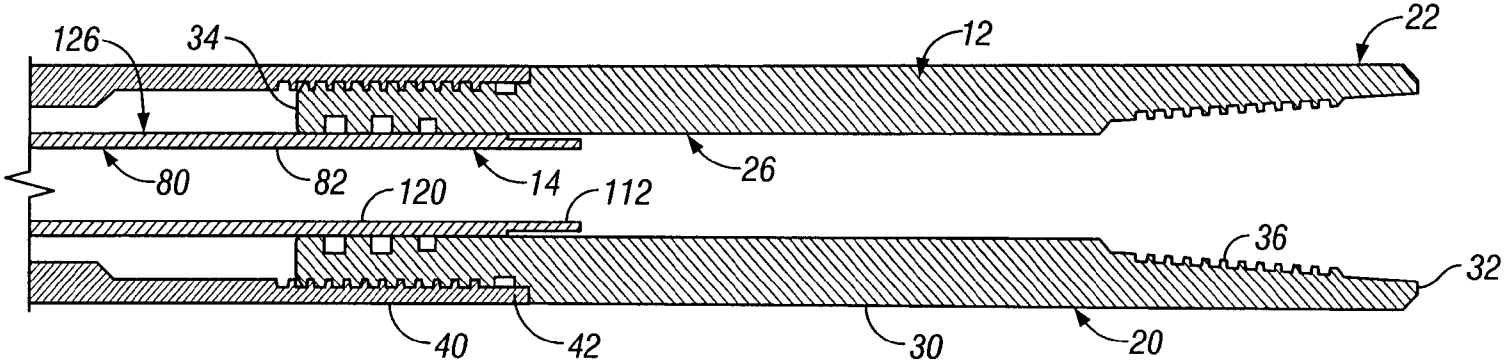
Figure 2A:
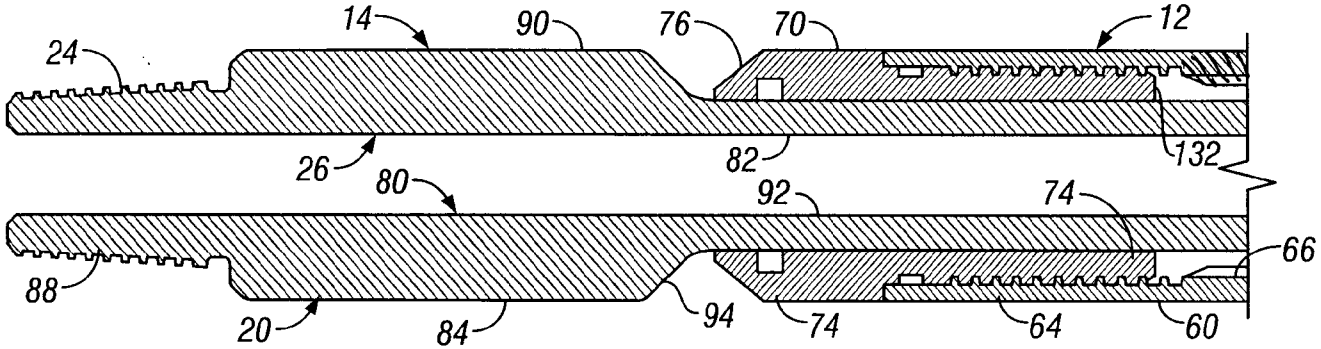
FIGS. 2A, 2B, 2C and 2D are sequential longitudinal sections of the hydraulic jar shown in the closed position.
Figure 2B:
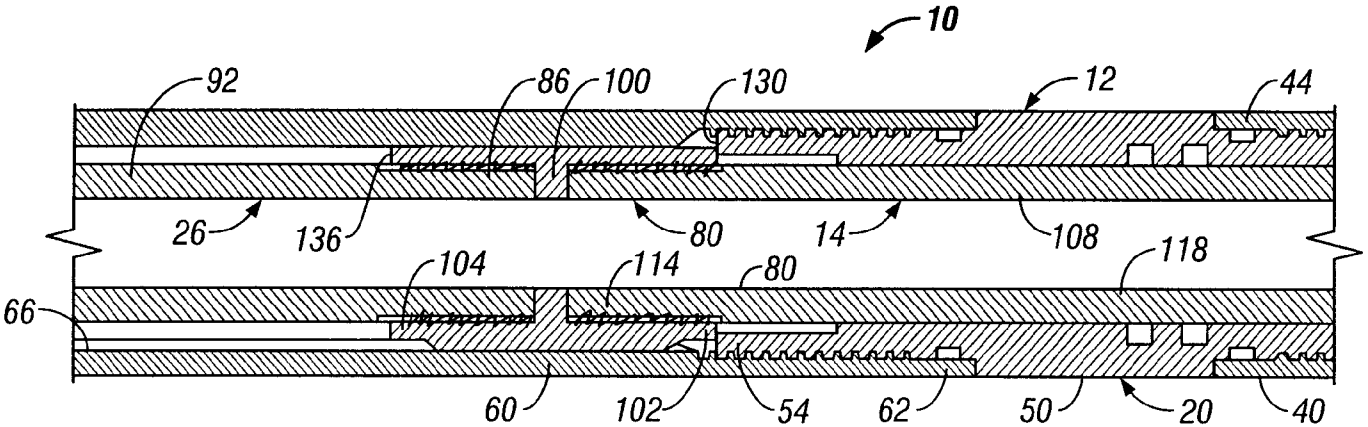
Figure 2C:
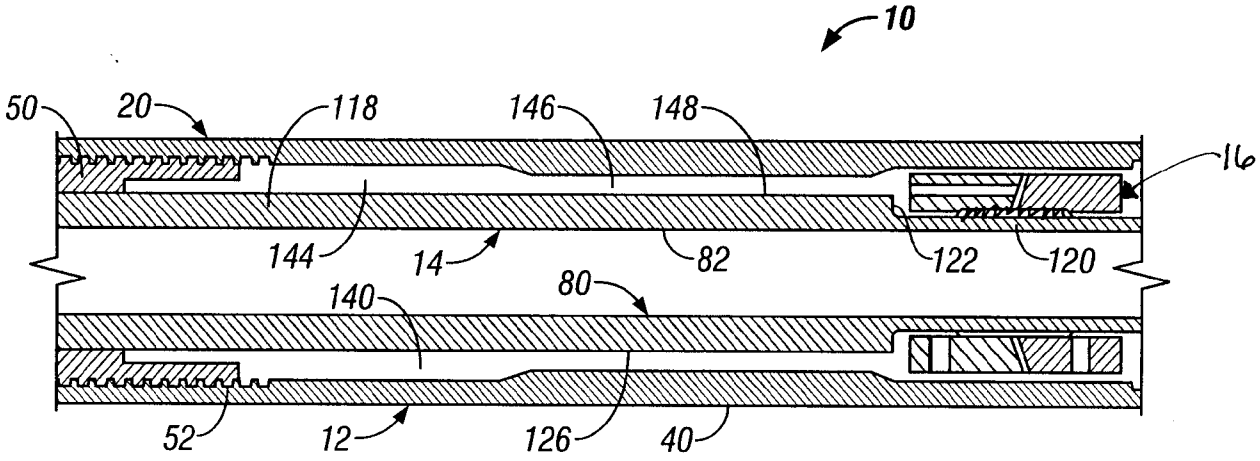
Figure 2D:
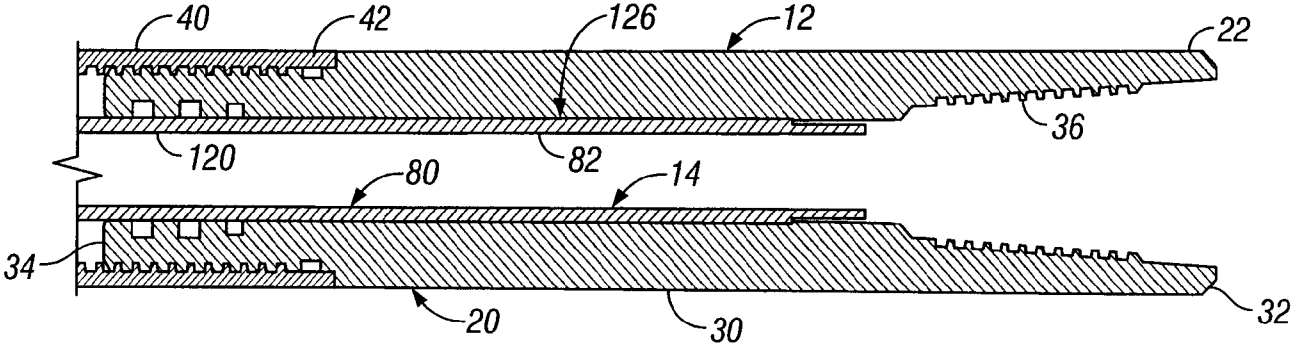

As mentioned previously, in this embodiment, the elongate body 80 of the inner assembly 14 includes an impact transfer member 100, best seen in FIGS. 1B and 2B. The first and second ends 102 and 104 of the impact transfer member 100 provide first and second impact surfaces 134 (FIG. 1B) and 136 (FIG. 2B), positioned to contact the first and second impact surfaces 130 and 132 on the outer assembly.

Where the inner assembly 14 is fixed to the stuck object (not shown) at the second end 88 of the lower mandrel 84 and the outer assembly 12 is supported on coil tubing at the first end 32 of the top sub 30, axial movement of the outer assembly by manipulation of the coil tubing causes the outer assembly to move back and forth on the inner assembly. Thus, when the outer assembly 12 is pulled in a first direction (to the right in FIGS. 1A–1D), the second impact surface 132 on the first end 86 of the lower mandrel sub 84 impacts the second impact surface 136 on the impact transfer member 100, as seen in FIG. 1B. This impact thrusts the jar 10 in the first or upward direction. When the outer assembly 12 is pushed is pushed in the opposite direction (to the left in FIGS. 2A–2B), the first impact surface 130 on the first end 52 of the connecting sub 50 impacts the first impact surface 134 on the impact transfer member 100 to thrust the jar 10 in a second or downward direction.

Where the inner assembly 14 is attached to the coil tubing and the outer assembly 12 is fixed to the stuck object (not shown), manipulation of the coil tubing causes the inner assembly to move back and forth in the outer assembly. Thus, when the inner assembly 14 is pulled in a first direction (to the left in FIGS. 1A–1D), the second impact surface 136 on the impact transfer member 100 impacts the second impact surface 132 on the first end 86 of the lower mandrel sub 84 to thrust the jar 10 in the first or upward direction (to the left in FIGS. 1A–1D). When the inner assembly 14 is. pushed is pushed in the opposite direction (to the right in FIGS. 2A–2B), the first impact surface 134 on the impact transfer member 100 impacts the first impact surface 130 on the first end 52 of the connecting sub 50 to thrust the jar 10 in a second or downward direction (to the right in FIGS. 2A–2D).

Most jarring tools comprise a hammer assembly in which one element is deemed the hammer, or striking member, and one element is deemed the anvil, or the impact receiving member. Now it will be seen that in this invention, the impact transfer member 100 of the inner assembly functions alternately as a hammer and an anvil, depending on whether the outer assembly 12 or the inner assembly 14 is attached to the coil tubing. Likewise, the first and second impact surfaces 130 and 132 on the outer assembly 12, may act as hammer or anvil surfaces, again depending on whether the inner or outer assembly is attached to the coil tubing.

Figure 3:
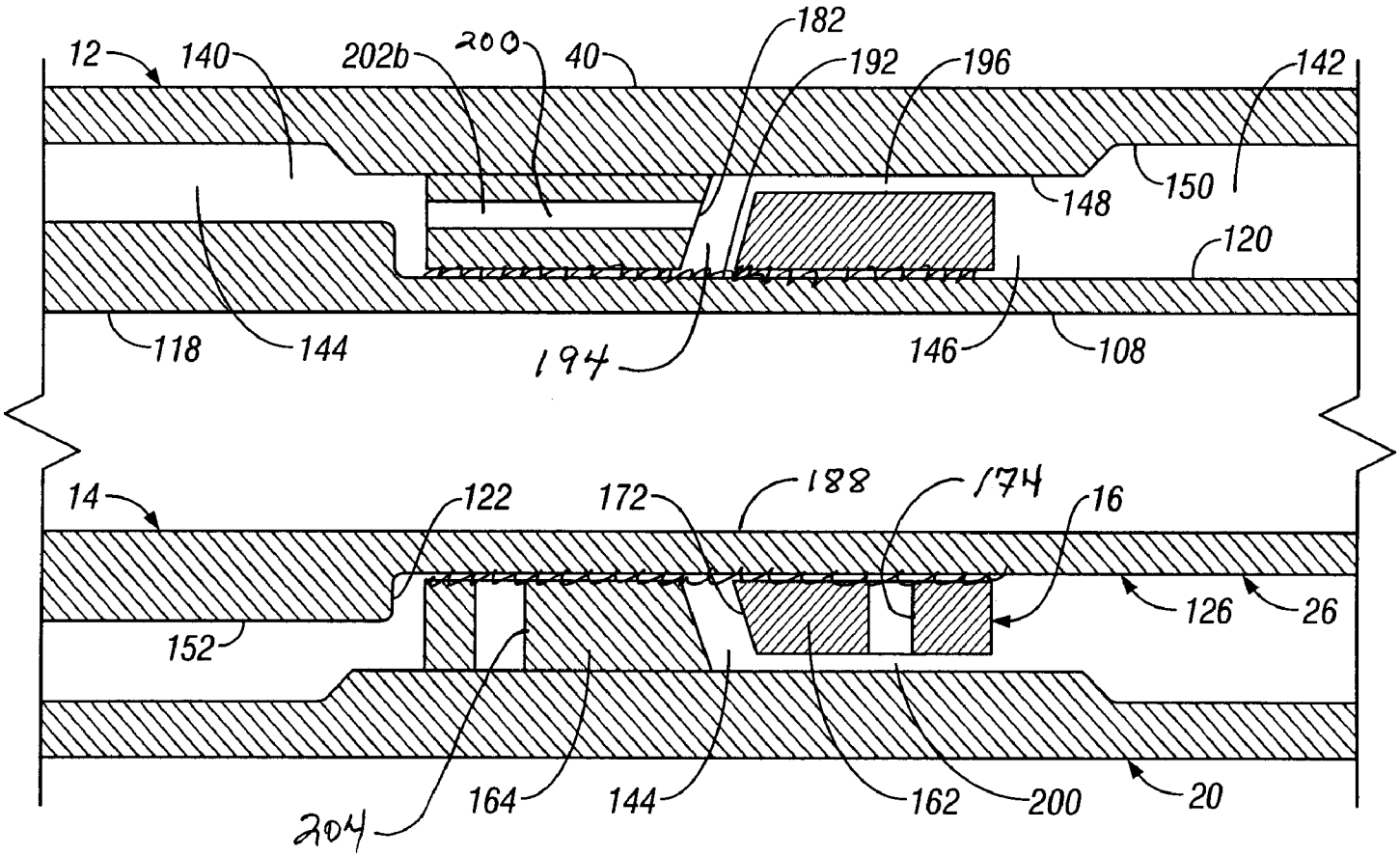
FIG. 3 is an enlarged longitudinal sectional view of the portion of the jar containing the valve assembly.

The jar 10 includes a hydraulic chamber enclosing the valve assembly 16 for creating the jarring impacts. To this end, an annular elongate fluid chamber 140 is formed between the outer wall 126 of the elongate body 80 of the inner assembly 14 and the inner wall 26 of the tubular body 20 of the outer assembly 12. As best seen in FIG. 3, the fluid chamber 140 comprises first and second portions 142 and 144. A restrictor portion 146 therebetween is formed by a smaller inner diameter section 148 of the fluid housing 40. The restrictor portion 146 has a smaller radial dimension than the first and second portions 142 and 144. In the illustrated embodiment, the fluid chamber 140 is formed by the inner bore 150 of the fluid housing 40 and the outer wall 152 of the inner mandrel 108.

The valve assembly 16 is supported in the fluid chamber 140 and fixed to either the outer wall 126 of the elongate body 80 of the inner assembly 14 or to the inner wall 26 of the tubular body 20 of the outer assembly 10. In the preferred embodiment, the valve assembly 16 is fixed to the reduced diameter portion 120 of the inner mandrel 108 adjacent the shoulder 122.

The valve assembly 16 is sized and positioned for reciprocal movement in the restrictor portion 146 as the outer assembly 12 is moved axially relative to the inner assembly 14. The valve assembly 16 is adapted to obstruct flow through the restrictor portion 146 except for a bleed passage, described in more detail below. This will create a delay as the valve assembly 16 moves through the restrictor portion 146 and then accelerated movement as the valve assembly exits the restrictor portion into either the first portion 142 or the second portion 144 of the fluid chamber 140. It is this sudden accelerated movement that generates the jarring impact when the first and second impact surfaces 132 and 134 of the outer assembly 12 engage the first and second impact surfaces 134 and 136 of the inner assembly 14.

Figure 4:
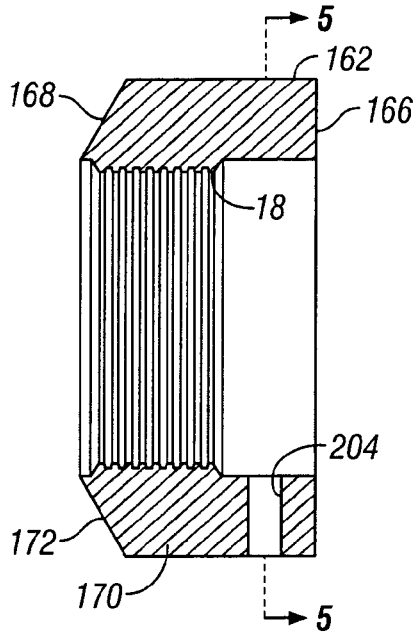
FIG. 4 is an enlarged longitudinal sectional view of the first valve ring.
Figure 5:
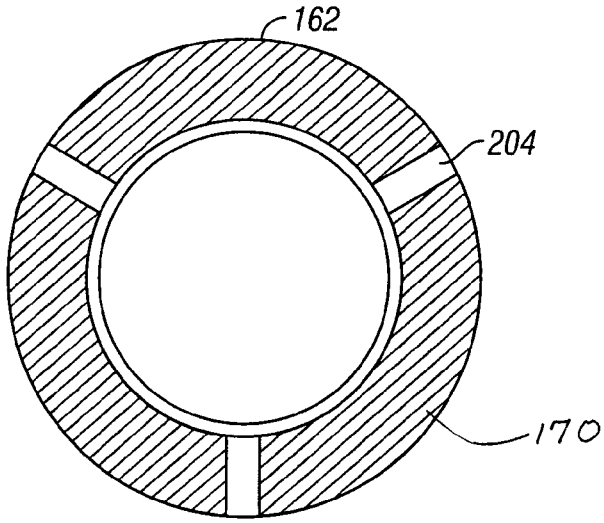
FIG. 5 is an enlarged cross sectional view of the first valve ring taken along the line 5—5 in FIG. 4.

With continuing reference to FIG. 3, the valve assembly 16 will be described in more detail. In its preferred form, the valve assembly 16 comprises first and second valve rings 162 and 164. The first valve ring 162, shown also in FIGS. 4 and 5, has first and second ends 166 and 168 and a body 170 therebetween. The second end 168 defines a metering face 172, which preferably is frusto-conical in shape. The first valve ring 162 preferably is made of 4140 heat treated alloy steel.

Figure 6:
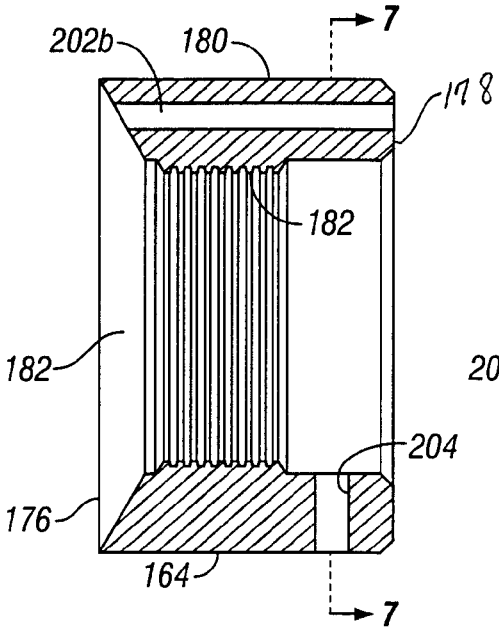
FIG. 6 is an enlarged longitudinal sectional view of the second valve ring.
Figure 7:
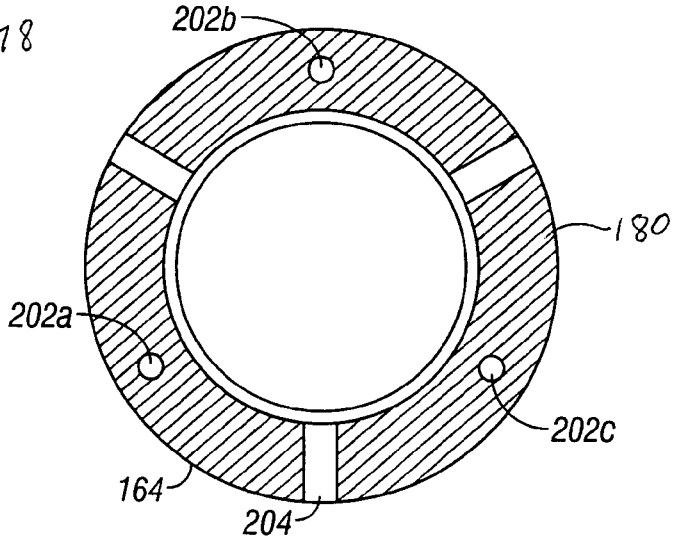

The second valve ring 164, shown in FIGS. 6 and 7, comprises first and second ends 176 and 178 and a body 180 therebetween. The first end 176 of the second ring 164 defines a metering face 182 adjacent the metering face 172 of the first valve ring 162. The second valve ring 164 preferably is made of ductile iron alloy.

In this embodiment, where the valve assembly 16 is fixed to the inner assembly 14, the first and second rings 162 and 164 are provided with threads 180 and 182 receivable on threads 192 formed on the reduced diameter portion 120 of the inner mandrel 108. When both rings 162 and 164 are positioned on the reduced diameter portion 120, with the adjacent ends 168 and 176 spaced a distance apart, the space therebetween forms a metering space 194.

With continued reference to FIG. 3, it will be appreciated that there must be a bleed space 200 through the restrictor portion 146 when the valve assembly 16 passes through it. In accordance with this invention, this bleed space 200 may go through one or both of the valve rings 162 and 164, or alternately may go through one of the valve rings and around the circumference of the other. In the embodiment shown herein, the first valve ring 162 is imperforate and is sized to permit passage of fluid around the circumference of its body 170 in the annular space 196 between the body and inner wall of the restrictor portion 146.

The circumference of the body 180 of the second valve ring 164 is sized for sealing engagement with the restrictor portion 146 and at least one pass-through opening is provided through the body. This pass-through opening is continuous with the metering space 194 and forms a part of the bleed passage 200. Preferably, the pass-through opening comprises three pass-through bores 202*a*, 202*b* and 202*c* extending end to end through the body 180 of the ring 164.

Where one of the rings is perforated by the pass-through bores, as is the ring 164, and one is imperforate, as the ring 164, it is advantageous to make both the metering faces 172 and 182 substantially frusto-conical so that the metering space 194 also will be frusto-conical, one complementing the other. This streamlines fluid flow between the pass-through bores 202*a*, 202*b*, and 202*c* and the annular space 196. Where both rings have pass-through bores, the metering space may or may not be frusto-conical.

Now it will be appreciated that the size of the metering space 194 is adjustable by moving at least one of the rings 162 and 164 axially relative to the other to vary the size of the space and thus the size of the bleed passage 200. Adjusting the size of the bleed passage varies the force and speed of the jarring impacts delivered by the jar 10. A larger metering space, and thus a larger bleed passage, creates faster movement of the valve assembly and a lesser impact. Conversely, a smaller metering space and a smaller bleed passage, provides a slower passage of the valve and greater impact.

In this embodiment, it is preferred to thread the first ring 162 axially toward or away from the second ring 164. Since both rings 162 and 164 are threadedly attached to the inner mandrel 108, set screws (not shown) may be used to secure the selected positions of the valve rings against unintended axial movement during operation of the jar 10. Thus, the rings 162 and 164 may be provided with one or more transverse openings, all designated collectively by the reference numeral 204.

In the preferred embodiment described herein, the valve assembly is mounted on the inner assembly for reciprocal movement inside a fluid chamber with a restrictor portion formed on the inside wall of the outer assembly. It will be appreciated, though, that this arrangement can be reversed as well. That is, the valve assembly can be fixed to the outer assembly, with the restrictor portion formed on the inner assembly.

Shown through the drawings, and not indicated by reference numerals, are various circumferential grooves provided at numerous locations in the jar 10 for O-rings to provided fluid seals as needed. The O-rings are omitted to simplify the illustrations.

Now it will be apparent that the bidirectional hydraulic jar of the present invention offers many features and advantages. The speed and force of impact can be easily adjusted. The jar can be re-cocked without a reverse jar by manipulating the jar so that the valve assembly is about centered in the restricting portion of the fluid chamber, and then reversing direction. This allows the jar to be used when jarring impacts are desired in one direction only. The impact points, both upper and lower, in this jar are both enclosed in the tubular body or housing. This prevents debris from accumulating at an exposed impact and causing dampening of the blow.

Changes can be made in the combination and arrangement of the various parts and elements described herein without departing from the spirit and scope of the invention as defined in the following claims.

What is claimed is:

1. A bidirectional hydraulic jar comprising:

an outer assembly comprising:

a tubular body with first and second ends, wherein the tubular body defines an inner wall, and wherein the first end comprises a connecting portion;

a first impact surface on the tubular body to transmit force in a first direction; and a second impact surface on the tubular body longitudinally spaced from the first impact surface to transmit force in a second direction opposite the first direction;

an inner assembly comprising:

an elongate body having a portion telescopically receivable within the outer assembly, the elongate body defining an outer wall and having first and second ends, and wherein the second end comprises a connecting portion;

a first impact surface on the elongate body adapted to engage the first impact surface on the tubular body of the outer assembly;

a second impact surface on the elongate body longitudinally spaced a distance from the second impact surface on the elongate body and adapted to engage the second impact surface on the tubular body of the outer assembly;

an annular elongate fluid chamber formed between the outer wall of the elongate body of the inner assembly and the inner wall of the tubular body of the outer assembly, the fluid chamber comprising first and second portions and a restrictor portion therebetween, the restrictor portion having a smaller radial dimension than the first and second portions; and a valve assembly supported in the fluid chamber and fixed to one of the outer wall of the elongate body of the inner assembly and the inner wall of the tubular body of the outer assembly, wherein the valve assembly is sized for reciprocal movement in the restrictor portion, and is adapted to obstruct fluid flow through the restrictor portion except for a bleed passage therethrough to create a delay as the valve assembly moves through the restrictor portion and accelerated movement as the valve assembly exits the restrictor portion into the first and second portions of the fluid chamber, and wherein the valve assembly comprises:

a first valve ring comprising first and second ends with a body therebetween, the first end defining a metering face;

a second valve ring comprising first and second ends with a body therebetween, the first end defining a metering face adjacent the metering face of the first ring and forming therewith a metering space between the first and second valve rings, the metering space forming part of the bleed passage;

wherein at least one of the first and second valve rings is sized for sealing engagement with the restrictor passage and comprises a pass-though opening continuous with the metering space and forming part of the bleed passage; and wherein the size of the metering space is adjustable by moving at least one of the first and second valve rings relative to the other to vary the size of the bleed passage;

whereby movement of a selected one of the outer assembly and inner assembly relative to the other one in a first direction causes jarring impacts between the first impact surfaces of the outer and inner assemblies to thrust the jar in a first direction, and movement of the selected one of the outer assembly and inner assembly relative to the other one in a second direction causes jarring impacts between the second impact surfaces of the outer and inner assemblies to thrust the jar in a second direction; and whereby adjusting the size of the metering space between the first and second valve rings varies the force and speed of the jarring impacts.

2. The hydraulic jar of claim 1 wherein the outer assembly comprises:

a top sub with a first and second end, the connecting portion formed on the first and being adapted for connection to an elongate conduit;

a fluid housing with first and second ends, the first end connected to the second end of the top sub;

a connecting sub with first and second ends, the first end being connected to second end of the fluid housing;

a hammer housing with first and second ends, the first end being connected to the second end of the connecting sub;

a lower mandrel with first end and a second end, the first end being connected to the second end of the hammer housing;

wherein the first impact surface of the outer assembly is formed on the second end of the connecting sub and wherein the second impact surface of the outer assembly is formed on the first end of the lower mandrel sub; and wherein the fluid housing comprises an inner bore that at least partially defines the fluid chamber.

3. The hydraulic jar of claim 2 wherein the inner assembly comprises:

a lower mandrel with first and second ends, wherein the lower mandrel has a first end section telescopically received in the lower mandrel sub of the outer assembly;

an impact transfer member with first and second ends, the second end connected to the first end of the lower mandrel, wherein the first and second ends form the first and second impact surface of the inner assembly;

an inner mandrel comprising an elongated body portion having an outer wall and a first end and a second end, the second end connected to the first end of the impact transfer member, wherein the body portion includes an intermediate section and a reduced diameter section extending from the first end to the intermediate section forming an annular shoulder therebetween, wherein outer wall of the inner mandrel at least partially defines the fluid chamber, and wherein the valve assembly is supported on the reduced diameter section adjacent the shoulder.

4. The hydraulic jar of claim 3 wherein the pass-through opening in the at least one of the first and second valve rings comprises a plurality of longitudinal bores extending end to end through the body.

5. The hydraulic jar of claim 1 wherein the inner assembly comprises:

a lower mandrel with first and second ends;

an impact transfer member with first and second ends, the second end connected to the first end of the lower mandrel, wherein the first and second ends form the first and second impact surface of the inner assembly;

an inner mandrel comprising an elongated body portion with a first end and a second end, the second end connected to the first end of the impact transfer member, wherein the body portion includes an intermediate section and a reduced diameter section extending from the first end to the intermediate section forming an annular shoulder therebetween, wherein the reduced diameter section at least partially defines the fluid chamber, and wherein the valve assembly is supported on the reduced diameter section adjacent the shoulder.

6. The hydraulic jar of claim 1 wherein the bleed space is adjustable by moving the second valve ring axially relative to the first valve ring.

7. The hydraulic jar of claim 1 wherein the valve assembly is supported on the inner assembly and the restrictor portion is formed on the inner wall of the outer assembly.

8. The hydraulic jar of claim 7 wherein the inner assembly is tubular providing a fluid conduit therethrough.

9. The hydraulic jar of claim 7 wherein the metering faces on the first and second valve rings are both substantially frusto-conical in shape, one complementing the other.

10. The hydraulic jar of claim 7 wherein the connecting portion on the outer assembly is adapted for connection to coil tubing and wherein the connection portion on the inner assembly is adapted for connection an object or tool downhole.

11. The hydraulic jar of claim 1 wherein the connecting portion on the outer assembly is a box end, and wherein the connecting portion on the inner assembly is a pin end.

12. The hydraulic jar of claim 1 wherein the first and second impact surfaces on the inner and outer assemblies all are enclosed by the outer assembly.

13. The hydraulic jar of claim 1 wherein the other of the first and second valve rings is imperforate and has a circumference sized for close fitting engagement with the restrictor portion so that the annular space therebetween forms part of the bleed passage.

* * * * *